United States Patent [19]

Pinto et al.

[11] Patent Number: 5,005,261

[45] Date of Patent: Apr. 9, 1991

[54] DEVICE FOR PNEUMATICALLY FEEDING FIBER MATERIAL TO A CHUTE OR THE LIKE

[75] Inventors: Akiva Pinto, Duesseldorf Wittlaer; Werner Lasenga, Duelmen, both of Fed. Rep. of Germany

[73] Assignee: Hergeth Hollingsworth GmbH, Dulmen, Fed. Rep. of Germany

[21] Appl. No.: 479,124

[22] Filed: Feb. 13, 1990

[30] Foreign Application Priority Data

Feb. 14, 1989 [DE] Fed. Rep. of Germany ..... 3904317

[51] Int. Cl.[5] ..... D01G 15/44

[52] U.S. Cl. ..... 19/105

[58] Field of Search ..... 19/105, 204; 138/39

[56] References Cited

U.S. PATENT DOCUMENTS

| | | | |
|---|---|---|---|
| 2,883,709 | 4/1959 | Deems et al. | 19/204 |
| 4,159,073 | 6/1979 | Liller | 138/39 |
| 4,317,260 | 3/1982 | Blackburn | 19/204 |
| 4,476,611 | 10/1984 | Keller et al. | 19/105 |
| 4,520,530 | 6/1985 | Pinto | 19/204 |
| 4,520,531 | 6/1985 | Hergeth | 19/105 |
| 4,697,309 | 10/1987 | Rudolph | 19/105 |
| 4,734,957 | 4/1988 | Lenzen | 19/105 |
| 4,779,311 | 10/1988 | Leifeld | 19/105 |
| 4,797,979 | 1/1989 | Stäheli et al. | 19/105 |

*Primary Examiner*—Werner H. Schroeder
*Assistant Examiner*—John J. Calvert
*Attorney, Agent, or Firm*—Bailey & Hardaway

[57] ABSTRACT

In a device for pneumatically feeding fiber to a machine such as a card or the like, the feed member (4) above the chute (2) is a tube of a circular or substantially circular cross section. The depth at the entrance of the chute (2) is less than the diameter of the tubular feed member (4).

6 Claims, 1 Drawing Sheet

FIG.1
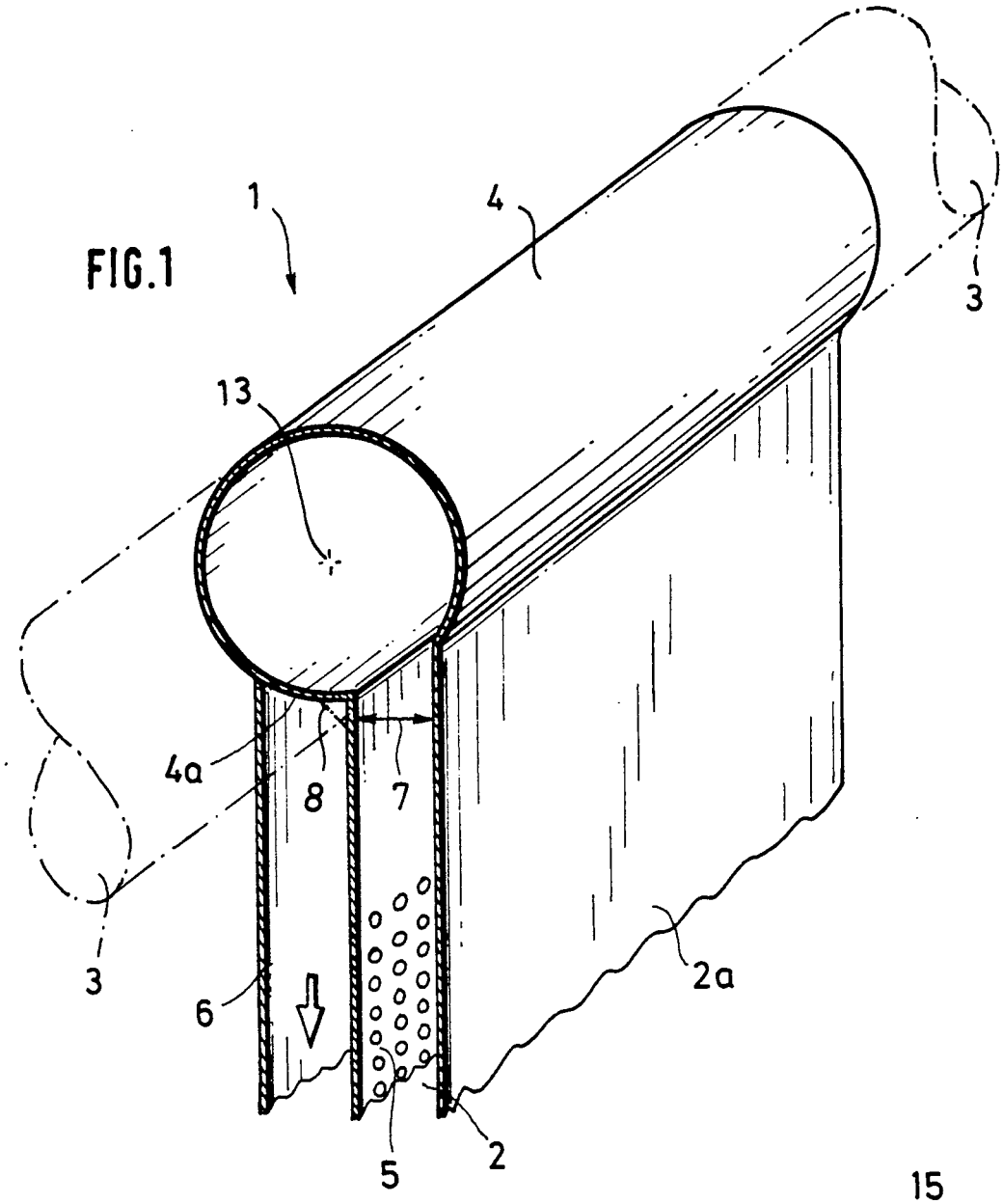
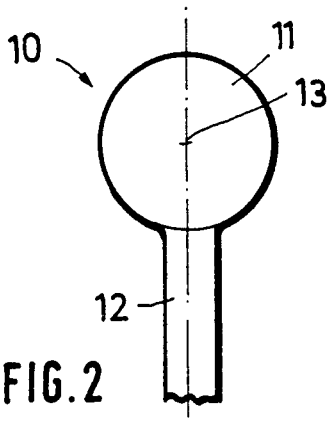
FIG.2
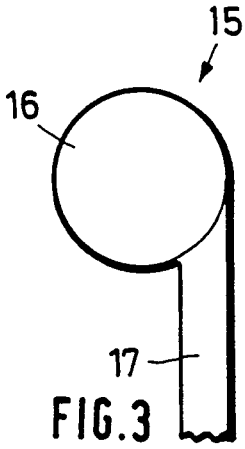
FIG.3

DEVICE FOR PNEUMATICALLY FEEDING FIBER MATERIAL TO A CHUTE OR THE LIKE

BACKGROUND OF THE INVENTION

The invention relates to a device for pneumatically feeding fiber flocks, e.g. cotton, synthetic fibers etc. to the next device, e.g. processing machine such as a card etc., in that, via a conduit, the fiber material is supplied to a feeding chute.

The pipe lines customarily used for pneumatically feeding fiber material have a round cross section, in other words, they are designed as tubular cylindrical parts having a circular cross section. For feeding a chute, serving for instance as a supply to a processing machine, the portion conducting the air-fiber-stock flow is box-shaped just like the chute by itself which mostly has an oblong rectangular cross section. The feed line by itself for pneumatically supplying the fiber material being a round channel, it is necessary to provide a transitory pipe member in which the round cross section gradually changes into an upright rectangular cross section. The feed subsection on the chute is a rectangular box corresponding to the horizontal rectangular cross section of the chute. The width of the feeding member is equal to that of the chute.

A box-shaped feed portion on the box-type feeding chute is unfavorable in many respects. Apart from the fact that during the flow through the transitory member from a circular cross section at the beginning to a rectangular cross section at the end, flow losses are caused by friction and so-called dead corners may be formed, a box-shaped feed member on the chute does not ensure a uniform distribution of the fiber flocks over the width of the chute with a resultant uniform formation of a fiber column. Therefore, the dropping of fiber flocks in the rectangular chute is relatively irregular and the fiber flock distribution over the width of the feeding chute is non-uniform. Fibers are accumulated at the bottom portion of the chute. A correction of the fiber column over the width of the chute as far as to the opening means etc. is rather accidental and mostly unachievable. This is particularly true if a plurality of chutes are fed by one and the same feed conduit. The feed member adapted to the cross section of the chute is relatively high so that a diffuse setting of the fibers is favored. Due to its height, the tubular feed conduit is relatively far away from the beginning of the chute thus excluding a certain air balance within the feed member. In addition, the input and exit of the tubular feed conduit are often directly provided to the feed member, thus resulting in sudden cross sectional changes which may bring about undesired turbulations so that the feeding of the fiber flow is no longer under control.

SUMMARY OF THE INVENTION

It is the object of the invention to provide an arrangement due to which the feeding of the air-fiber material flow may be realised in a calm atmosphere to thus obtain a better and more favorable distribution of the fed fibers or fiber flocks to the feeding chute. The invention is a tubular feed member of substantially circular cross section disposed above and integral with a feeding chute having a width less than the diameter of said tubular feed member.

Due to the circular tube used as a feed member above the chute, many important advantages may be realised. First, no transitory member for the various cross sections at the beginning and end of the feed member need be provided. Moreover, there are considerable advantages from the flow technique viewpoint in connection with the supply of the air-fiber material flow within the feed conduit to the chute. The cross section of the feed line outside and above the chute remains unchanged. The formation of interfering air turbulences is excluded. A blocking or bridge formation of the material may not occur. The channel resistance is low thus causing a saving in power. A low air speed is accompanied by favorable travel properties of the fiber flow. The construction is of a simple design and the installation properties are flexible.

Preferably, the diameter of the feed member is larger than the width of the feeding chute which, conveniently, is less than half the diameter. As a result, a portion of the tubular feed member hangs over the exterior wall of the chute so that, particularly in case of consecutively provided feeding chutes, part of the air-fiber material may freely flow past one and to the next chute. Again, the straight air flow is maintained and a turbulence formation is avoided. The suction effect in the chute being generally maintained for evacuating the transport air from the chute, the fiber material is taken over the total feed member width and into the chute. Thus, the distribution of the fibers during the filling and piling operations in the feeding chute is substantially improved and the density of the resultant fiber column is more uniform.

One may prefer that the one broad side of the chute joins the peripheral surface of the tubular feed member. However, the chute also may begin in the center plane of the circular tube cross section or somewhat offset thereto at the tubular feed member.

BRIEF DESCRIPTION OF THE DRAWINGS

One embodiment of the invention will be explained in more detail with reference to the drawings herein in which FIG. 1 shows a perspective and schematic view of one embodiment of the invention and, FIGS. 2 and 3 show schematic views of other embodiments of the invention.

DESCRIPTION OF THE PREFERRED EMBODIMENT

The device 1 of FIG. 1 for pneumatically feeding fiber flocks comprises a feeding chute 2 connected to a pneumatic feed conduit 3 whose cross section is usually circular. The feed member 4 above the chute 2 is also a tube of substantially circular cross section and its dimension will generally agree with that of the tubular feed conduit.

One wall of chute 2 is provided with air passages 5 extending to a housing 6 from which the transport air is removed by a suction blower, said chute being preferably so arranged at the tubular feed member 4 that one wall 2*a* substantially adjoins the peripheral surface of the tubular feed member such as evident from the drawing. The width 7 of chute 2 is less than half the diameter of the tubular feed member 4.

In case of such an arrangement the air fiber material flow present in conduit 3 and in tubular member 4 will so behave that the fiber material with the absorbed air current will uniformly extend in a substantially straight line over the width of the chute 2, into which uniform portions of the fiber material drop. The rest of the air-fiber material flow will move on in the discharging portion of the feed conduit 3 along the bottom surface 4*a* adjoined to the following section of the feed conduit 3. The flow at the feed member remains laminar in view of an unchanged cross section. There is no longer any reason for the formation of a turbulence.

The abutting edge between bottom surface 4*a* of the feed member 4 and the adjacent chute wall is more or less rounded off. It is also possible to provide a chamfer 8.

In case of the embodiment 10 of FIG. 2, the chute 12 is situated in the longitudinal center plane 13 of the tubular feed member 11 in which free spaces exist on both sides of its center.

In case of the embodiment 15 of FIG. 3, one broad side of chute 17 adjoins the peripheral surface of the tubular feed member 16.

One may also provide any other intermediate position between the arrangements of FIGS. 1-3.

What is claimed is:

1. Apparatus for pneumatically feeding fiber through a conduit to a processing machine comprising:

an upper chute connected to and receiving fiber from said conduit, said upper chute comprising a tube of substantially circular cross section; and a sequential lower chute, said lower chute at its entrance from said upper chute having a width less than the diameter of said upper chute;

wherein the flow of fiber through said conduit moves through said upper chute such that fiber flows in a substantially straight line through said upper chute and allows fibers to drop into said lower chute.

2. The structure set forth in claim 1 wherein one side of said lower chute adjoins the peripheral surface of said upper chute.

3. The structure set forth in claim 1, wherein said lower chute is offset relative to the center of said upper chute.

4. The structure set forth in claim 1, wherein an abutting edge between a bottom surface of the upper chute is provided with a chamfer.

5. The structure set forth in claim 1, wherein the entrance of said lower chute has a width that is less than half the diameter of said upper chute.

6. Apparatus for pneumatically feeding fiber through a conduit to a processing machine comprising:

an upper chute connected to and receiving fiber from said conduit, said upper chute comprising a tube of substantially circular cross section substantially equal to that of said feed conduit; and a sequential lower chute, said lower chute at its entrance from said upper chute having a width less than the diameter of said upper chute;

wherein the flow of fiber through said conduit moves through said upper chute such that fiber flows in a substantially straight line through said upper chute and allows fibers to drop into said lower chute.

* * * * *